United States Patent [19]

Sadwick et al.

[11] Patent Number: 5,018,717

[45] Date of Patent: May 28, 1991

[54] SHEET STACKING APPARATUS

[75] Inventors: Paul V. Sadwick, Palm Bay, Fla.; Michael K. Sabocheck, Marion, N.Y.

[73] Assignee: Xerox Corporation, Stamford, Conn.

[21] Appl. No.: 76,979

[22] Filed: Jul. 23, 1987

[51] Int. Cl.[5] ..... B65H 31/00

[52] U.S. Cl. ..... 271/207; 271/213; 271/214; 271/215; 271/218

[58] Field of Search ..... 271/306, 176, 177, 180, 271/207, 213, 214, 215, 217, 218; 270/53, 58; 414/43, 45, 46, 48, 49, 50, 54, 62, 98, 100, 101, 102

[56] References Cited

U.S. PATENT DOCUMENTS

| | | | |
|---|---|---|---|
| 3,747,920 | 7/1973 | Linkus | 271/85 |
| 4,189,133 | 2/1980 | Arrasmith et al. | 271/217 X |
| 4,189,270 | 2/1980 | Ehrlich | 271/218 X |
| 4,359,218 | 11/1982 | Karis | 271/188 |
| 4,423,995 | 1/1984 | Karis | 414/43 |
| 4,477,218 | 10/1984 | Bean | 414/36 |
| 4,479,641 | 10/1984 | Bean et al. | 270/53 |
| 4,575,296 | 3/1986 | Kockler et al. | 270/53 X |
| 4,615,521 | 10/1986 | Mori | 414/45 X |
| 4,616,821 | 10/1986 | Boeve et al. | 271/213 |
| 4,669,717 | 6/1987 | Yamashita et al. | 271/213 X |

*Primary Examiner*—David H. Bollinger

*Attorney, Agent, or Firm*—H. Fleischer; J. E. Beck; R. Zibelli

[57] ABSTRACT

An apparatus in which an elevator movably supports a drawer having a tray associated therewith. The tray receives successive sheets at a loading station. The elevator moves continuously downwardly to maintain the uppermost sheet of the stack of sheets on the tray at a preselected location in the loading station until the drawer and tray are positioned at a discharge station located interiorly of a housing. The sheets are transferred from the tray to the drawer which advances the sheets from the discharge station to an unloading station located externally of the housing. A door opens, in synchronism with the movement of the drawer, to enable the sheets to pass from the discharge station to the unloading station located exteriorly of the housing.

28 Claims, 4 Drawing Sheets

FIG. 3

SHEET STACKING APPARATUS

This invention relates generally to an electrophotographic printing machine, and more particularly concerns an apparatus for stacking sets of finished copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the change thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are collected and bound or stapled together into sets of copy sheets. The bound or stapled sets of copy sheets are then stacked for presentation to the machine operator.

In a high speed commerical printing machine of the foregoing type, large volumes of sets of finished copy sheets are fed onto a stacking tray. When the tray is loaded to its capacity, an elevator moves the tray to a station where the operator can readily remove the sets of finished copy sheets. Frequently, the printing machine is idling and not producing copy sets while the operator is unloading the previously finished sets of copy sheets from the stacking tray. This reduces the productivity time of the printing machine and increases its down time. Ideally, high capacity printing machines should be run on a continuous basis. Thus, as the sets of copy sheets are being unloaded from the printing machine, other sets are being completed and stacked so as to be rapidly unloaded upon the operator completing the unloading of the first batch of sets of copy sheets. Accordingly, it is desirable for the printing machine to have an unload while run capability.

Various approaches have been devised for stacking and unloading sets of copy sheets. The following disclosures appear to be relevant:

U.S. Pat. No. 3,747,920 Patentee: Linkus Issued: Jul. 24, 1973

U.S. Pat. No. 4,359,218 Patentee: Karis Issued Nov. 16, 1982

U.S. Pat. No. 4,423,995 Patentee: Karis Issued: Jan. 3, 1984

U.S. Pat. No. 4,477,218 Patentee: Bean Issued: Oct. 16, 1984

U.S. Pat. No. 4,479,641 Patentee: Bean et al. Issued: Oct. 30, 1984

The relevant portions of the foregoing patents may be summarized as follows:

Linkus discloses a sheet unloading apparatus used in conjunction with a punch press. A trolley moves material from a loading position to an unloading position. A support table receives sheets from the trolley and is vertically movable by a motor operated scissors type of support.

Karis (U.S. Pat. No. '218) describes a sheet collection and discharge system. Sheets continuously accumulate at a stacker station. A table supported for vertical movement on scissor type collapsible legs receives the sheets. The lower ends of the legs have rollers for transversing the apparatus across linear tracks. The table has a base platform element, the under surface of which is formed with connection pieces to which the upper ends of the support legs are attached. A series of spaced apart columns extend vertically from the upper surface of the table platform. Each column is generally rectangular with a longitudinal axis parallel to the longitudinal axis of the apparatus. The upper surfaces of the columns support the stack of sheets at the stacker station. Interspaced between the table carrying columns are a series of lateral belt conveyors driven by a motor through a series of rollers. The belt conveyors discharge sheets in a batch onto a discharge table surface after the upper carrying surfaces of the table have descended beneath the level of the conveyor belts.

Karis (U.S. Pat. No. '995) discloses a continuous sheet feeding machine provided with a sheet collection area for receiving and stacking sheets into either ream or skid loadings. Two separate scissor type lift tables and discharging devices are provided for the two types of piling methods. Motor driven screw arrangements shuttle the different lift tables into their proper positions. The ream table has a table base portion secured to the ream collection frame and a vertically movable table top portion on which a ream size pile of sheets can be collected in the collection area. Scissor type lift means are suitably connected between the table base and table top to raise and lower the table top. The table top has a series of parallel, spaced apart platform surfaces which fit in the spaces between the discharge conveyor belts, such that, after a ream pile has accumulated on the table top, the ream pile may be transferred to the discharge conveyor belts by lowering the table top beneath the level of the belts. The conveyor belts than draw the ream pile off the table top.

Bean describes an offset stacker having a frame provided with a tray located therein which is movable between an upper stacking station and a lower discharge station. Movable jogger arms aid in accumulating sets of sheets on the tray in an offset manner at a loading station. The tray is moved down to the discharge station by a pulley device to present stacked materials for removal from the stacker. The tray includes cutouts in registry with rollers so that the rollers may protrude above the tray at the discharge station.

Bean et al. teaches a paper handling system for use with a duplicating machine. Paper sheets are collected into sets and are transported to a finishing station where they are bound into pamphlets. The sheets are then stacked on a tray at a stacking station and moved to a discharge station. A discharge conveyor transports stacked sheets to a shelf for removal. The discharge station includes a discharge conveyor system which consists of a pair of belts which may run from the tray to the end of the discharge station. Rollers located within the stacker, extend upwardly through the tray to displace a stack of pamphlets to the conveyor system.

In accordance with one aspect of the present invention, there is provided an apparatus for stacking sheets. The apparatus includes means for supporting sheets.

The supporting means receives sheets at a loading station. Means are provided for advancing the sheets from a discharge station to an unloading station. First means move the supporting means and the advancing means from the loading station to the discharge station. Second means move the supporting means relative to the advancing means, at the discharge station, to transfer the sheets from the supporting means to the advancing means. An enclosure has an aperture therein with the discharge station being located interiorly of the enclosure and the unloading station being located exteriorly of the enclosure. Means are provided for opening and closing the aperture in the enclosure. The opening and closing means opens the aperture in the enclosure in synchronism with the advancing means moving the sheets from the discharge station to the unloading station to enable the sheets to pass therethrough.

Pursuant to another aspect of the features of the present invention, there is provided an electrophotographic printing machine of the type in which successive copy sheets having indicia recorded thereon are advanced to a finishing station. The printing machine includes means for supporting sheets. The supporting means receives sheets at a loading station. Means are provided for advancing the sheets from a discharge station to an unloading station. First means move the supporting means and the advancing means from the loading station to the discharge station. Second means move the supporting means relative to the advancing means, at the discharge station, to transfer the sheets from the supporting means to the advancing means. An enclosure has an aperture therein with the discharge station being located interiorly of the enclosure and the unloading station being located exteriorly of the enclosure. Means are provided for opening and closing the aperture in the enclosure. The opening and closing means opens the aperture in the enclosure in synchronism with the advancing means moving the sheets from the discharge station to the unloading station to enable the sheets to pass therethrough.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
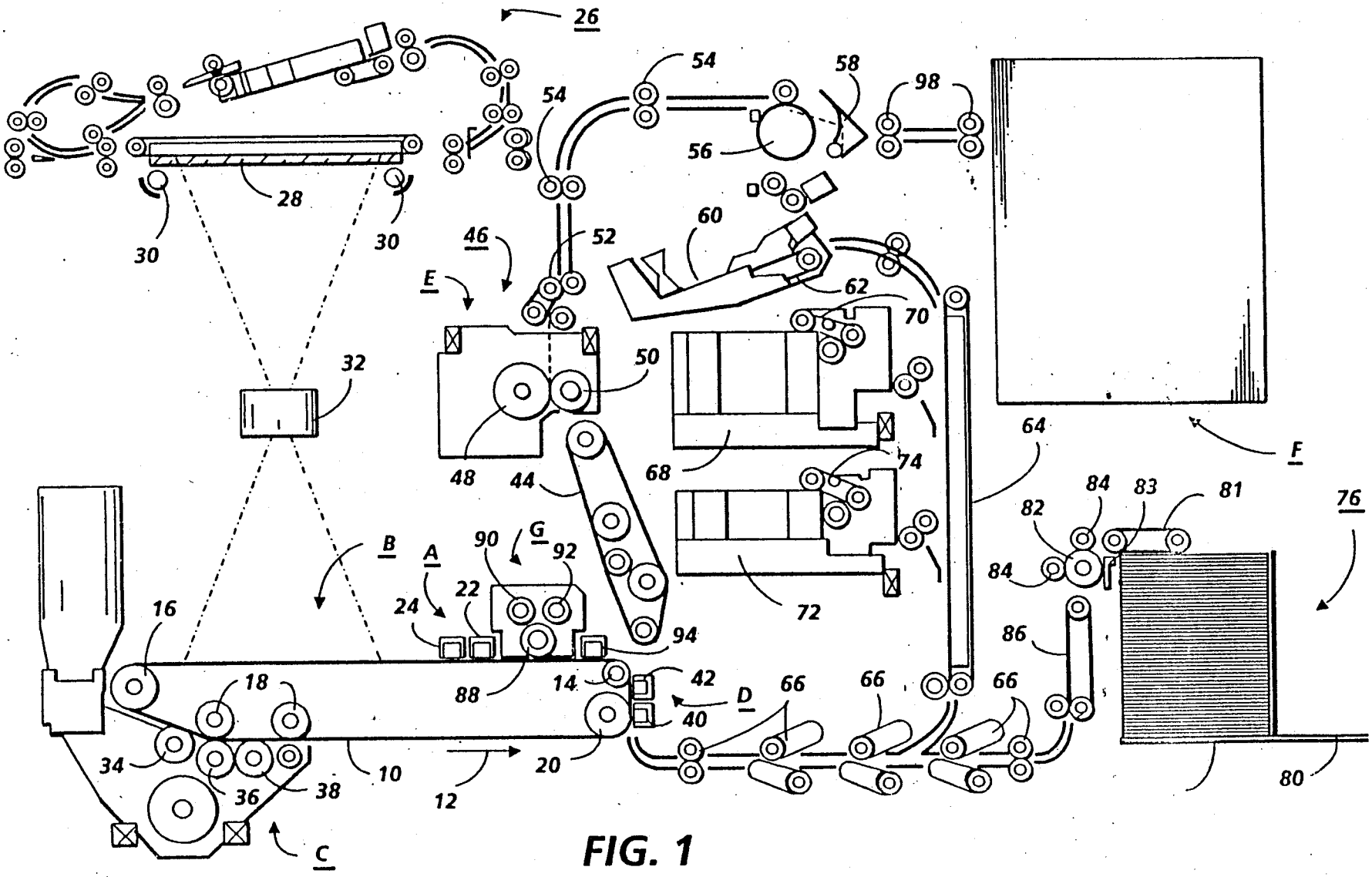
FIG. 1 is a schematic elevational view depicting an illustrative electrophotographic printing machine incorporating the sheet stacking apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet stacking apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-mtolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds documents from a stack of docuements placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in a compiler tray and attached to one another to form sets. The sheets are attached to one another by either a binding device or a stapling device. In either case, a plurality of sets of documents are formed in finishing station F. The details of finishing station F will be described hereinafter with reference to FIG. 2. When duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
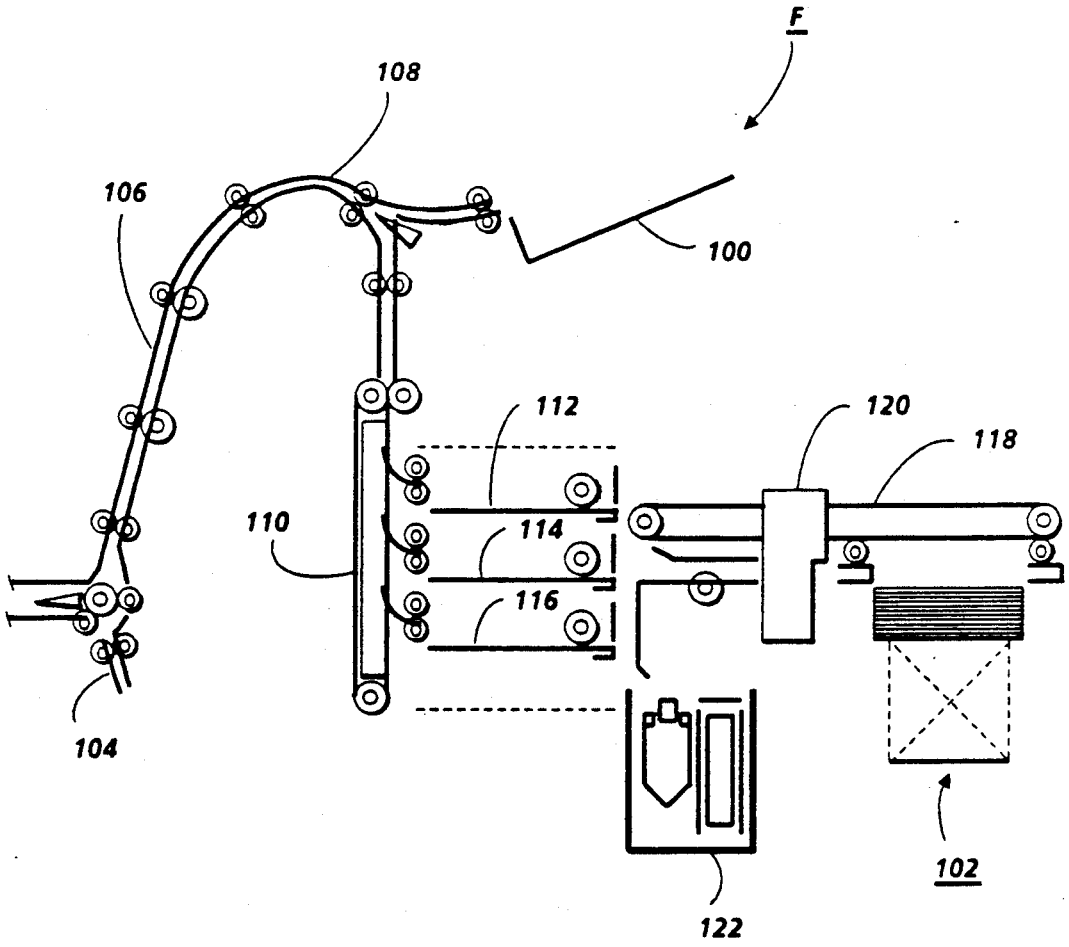
FIG. 2 is a schematic elevation view showing the finishing station of the FIG. 1 printing machine with the sheet stacking apparatus.

Referring now to FIG. 2, the general operation of finishing station F will now be described. Finishing station F receives fused copies from rolls 98 (FIG. 1) and delivers them to the top tray 100 or to the sheet stacking apparatus of the present invention, indicated generally by the reference numeral 102. The details of sheet stacking apparatus 102 will be described hereinafter with reference to FIGS. 3 and 4. Sets of copy sheets delivered to sheet stacking apparatus 102 may be either collated or uncollated, and finished or unfinished. Unfinished sets may be offset, and finished sets stitched with one or two stitches. Finishing station F can also bind sets and deliver stacks of bound sets to stacking apparatus 102. The sheet path of finishing station F has an inverter 104 driven by a reversible AC motor. The inverter has a solenoid actuated diverter gate that diverts sheets into the inverter, and a tri-roll nip that is used to drive sheets into and out of the inverter. It also has a compression spring which assists in reversing the direction of the sheets and assists in driving them out of the inverter. Registration transport 106 is used to transport sheets from inverter 104 to output transport 108 Two cross roll registration nips are used to register the sheets. The cross roll registration nips are driven by the sheet path drive motor. The output transport 108 is driven by the sheet path drive motor. It transports sheets from the registration transport to the top tray gate where the sheets are diverted to either vacuum transport 110 or into top tray 100. Vacuum transport 110 is used to transport sheets from transport 108 to any one of three bins 112, 114 or 116. Bins 112, 114, and 116 are used to compile and register sheets into sets. The bins are driven up or down by a bidirectional AC bin drive motor adapted to position the proper bin at the unloading position. A set transport 118 has a pair of set clamps mounted on two air cylinders and driven by four air valve solenoids. Two of the air valves are used for positioning the set transport and two are used for the retract function. The set transport is used to transport sets from the bins to the stitcher 120, binder 122 and sheet stacking apparatus 102. The stitched, bound, or unfinished sets are delivered to stacking apparatus 102 where they are stacked for delivery to the operator.

Figure 3:
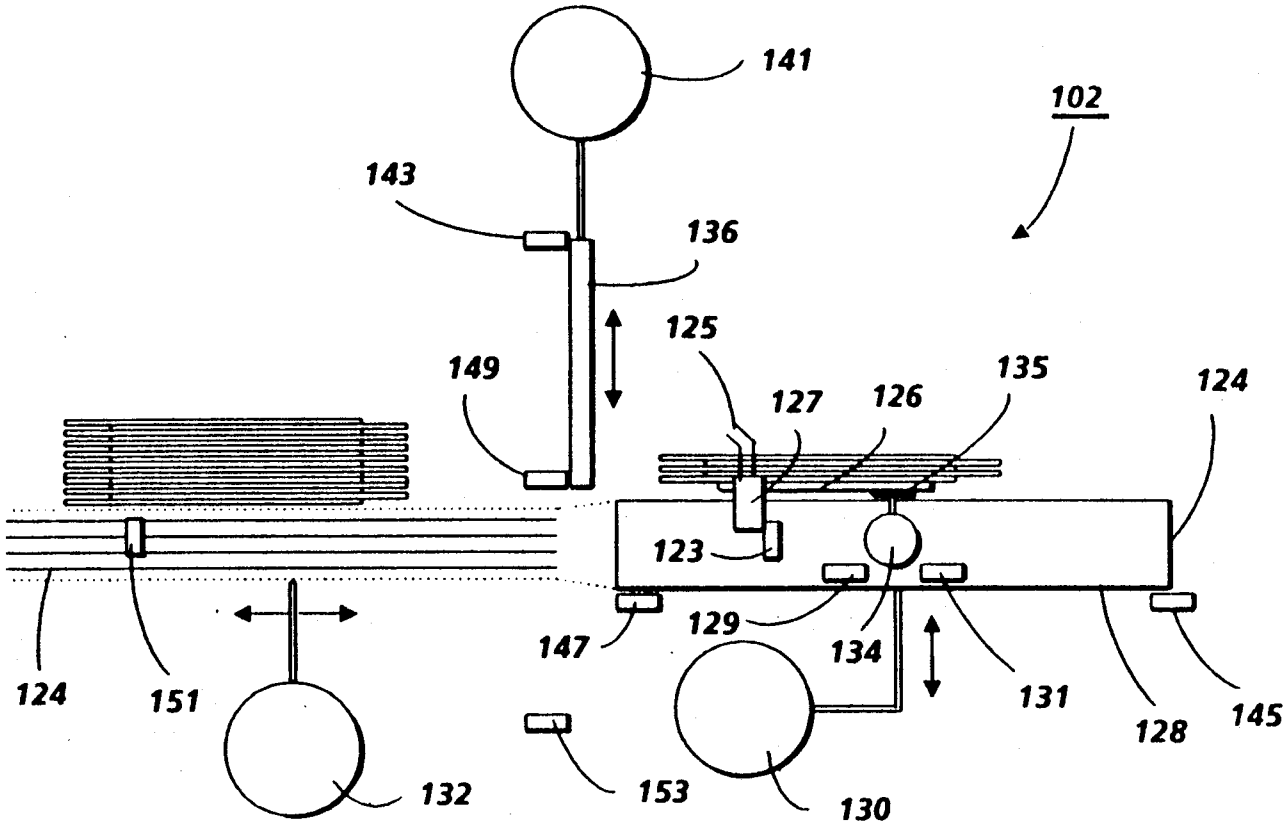
FIG. 3 is a schematic elevational view illustrating the sheet stacking apparatus of the FIG. 2 finishing station.

Turning now to FIG. 3, there is shown a schematic illustration of stacking apparatus 102. Stacking apparatus 102 has a stack delivery drawer 124 and a stack offset tray 126 both of which are mounted on a platform elevator 128 that is driven by a bi-directional AC motor 130. The stack delivery drawer 124 is driven in and out of the printing machine by a bi-directional AC motor 132. During loading, motor 130 moves elevator 128 upwardly to position tray 126 and drawer 124 at the loading station. Tray 126 is raised so that the tray surface is about 8 millimeters above the surface of drawer 124. The stacker offset tray 126 is moved to its' two offset positions by a bi-directional AC motor 134 coupled to a surface cam 135. Cam 135 has a groove that a pin attached to the lower portion of tray 126 follows when motor 134 rotates cam 135. This groove translates the motor rotational movement into forward or reverse movement depending upon the direction that motor 134 is commanded to rotate. Guide pins in slots on the lower portion of tray 126 allow forward or reverse movement of the tray while maintaining the tray position on drawer 124. Switches 129 located on the top of the elevator at the front and rear of tray 126, when actuated, signal to the controller that the tray is in the forward or reverse position. The controller, in turn, signals to stop forward or reverse movement. In this way, while sets are being loaded onto the tray, the tray alternately offsets the sets about 24 millimeters, and the elevator motor indexes the tray and drawer downwardly to maintain proper stack height. A stack bale 125 mounted on the rear of the set transport carriage above tray 126 moves down after each set of copy sheets is loaded on tray 126 to press each newly loaded set of copy sheets down to yield maximum set capacity. An air valve and solenoid 127 move bale 125 using air pressure. Timing and duration is controlled by the controller of the printing machine. After the selected number of sets of copy sheets have been loaded on tray 126, elevator 128 is moved downwardly by motor 130 to the discharge station. Alternatively, if the maximum number of sets of copy sheets have been loaded on tray, 126, elevator 128 has been moved downwardly by motor 130 to position tray 126 and drawer 124 at the discharge station. At the discharge station, tray 126 is lowered so that the upper tray surface is below the upper drawer surface. The up and down movement of tray 126 is controlled by cam 135. Cam 135 produces the up and down movement when motor 134 rotates. Rollers, attached to the tray, ride on the lobes of the cam. The high points of the lobes lift the tray up and the low points lower the tray allowing up and down movement of the tray while maintaining tray position. The cam lobes and the groove are placed in such a manner that the up and down movement and the forward and reverse movement occur at difference arc segments of the rotation of motor 134. As the cam rotates 75° counter clockwise, the tray moves forward. As the cam rotates clockwise 75° tray 126 reverses and returns. As the cam rotates counter clockwise 45° (from the initial 75° ), the upper surface of tray 126 drops lower than the upper surface of drawer 124 transferring the sets of copy sheets from the tray to the drawer. This occurs at the discharge station, where the sets of copy sheets are transferred from the tray to the drawer for delivery to an intermediate station. During the delivery cycle, the stack delivery drawer is driven out of the machine to an intermediate station, and as soon as the drawer is at the intermediate station external of the finishing station, the drawer and stacker tray are moved upwardly to return the tray to the loading station, and position the drawer at a convenient location for operator access, about 74 centimeters above the floor, for easier unloading of the sets of copy sheets therefrom at the unloading station. This action positions the tray at the loading station where it is ready to receive additional sets, and also positions the drawer with the stack of sheets thereon at the unloading station. A safety door 136, driven by a bi-directional AC motor 141, opens to permit the stack delivery drawer 124 to move from the discharge station to the intermediate station and then to the unloading station. FIG. 3 shows stack delivery drawer 124 to the left when it is at the intermediate station and to the right when it is located at the discharge station where the stack of sheets is being transferred from tray 126 to drawer 124. Door 136 is closed when drawer 124 is in the machine during delivery of sets of sheets to tray 126 when it is in the loading station. After the sets of sheets have been transferred to the stack delivery drawer at the discharge station, the door is driven up to allow the stack delivery drawer to deliver the stack of sets to the unloading station where the operator may remove the sets.

In operation, motor 130 moves elevator 128 having tray 126 and drawer 124 mounted thereon to its uppermost position at the loading station. At the loading station, sets of sheets are advanced onto tray 126. A stack height sensor 123 comprising two sections placed at the front and rear of tray 126, above the tray. Each section has a light emitting diode and a photodetector. Each light emitting diode directs a light beam across the top of the tray so that if either light beam is blocked, the photodetector signals that a set of copy sheets is blocking the array. Between loading successive sets of copy sheets, the controller interrogates the sensor array state, If the sensor array state indicates a light beam is blocked by the stack then the controller signals to motor 130 to turn on and drive elevator 128 down moving tray 126 down until the sensor array state changes to signal that the stack of copy sheets is clear of both light beams. The process continues so as to maintain the uppermost sheet on the tray at a fixed position for receiving successive sets. Motor 130 is located on the base of the finisher station frame towards the rear of the sheet stacker area. Motor 130 supplies rotational drive, via a drive belt and pulleys, to the lower end of two vertical lead screw. The lead screw passes through a nut affixed to the side of the elevator to move the elevator up or down. A stack hold position switch, located near the bottom elevator path of movement, is actuated when the elevator moves down. The controller is programmed, at this point, to calculate the remaining number of sets to be placed on the tray based on an internal program using look-up tables which consider such things as; set sheet count, sheet length, stitch or bind option selected, etc.. When the calculated set quantity is reached, a delivery cycle is initiated to deliver the completed stack of sets to the operator. At this time, motor 141 is energized to move door 136 upwardly. When door 136 is fully up, switch 143 is actuated. Switch 143 signals the controller that the path is now clear for drawer 124 to deliver the sets of copy sheets from the discharge station to the unloading station.

Tray 126 is made from several horizontal struts equally spaced from one another and defining a horizontal surface for supporting the sets of sheets of the stack. Drawer 128 is made from three horizontal struts equally spaced from one another and defining a horizontal stack support surface. The drawer struts extend along the tray spaces and the tray struts extend along the drawer spaces so that tray struts pass through the drawer spaces, i.e. tray struts are positioned within grooved cutouts in the drawer. As the tray struts lower, the upper surface of the tray struts descends beneath the upper surface of the drawer struts to transfer the stack of sets of sheets from the tray to the drawer. This occurs at the discharge station. A switch 131 located on elevator 128 is actuated when the tray is in the lowered position. When actuated, this switch signals to the controller that tray 126 is in the down position and switch 143 indicates that door 136 is in the up position. With door 136 in the up position, drawer 124 can pass through the opening with the stack of sets of sheets thereon. The controller, in turn, actuates motor 132 to move drawer 124 horizontally from the discharge station to the intermediate station. When drawer 124 with the stack of sets of sheets thereon is at the intermediate station, switch 145 is opened and switch 147 is closed. Motor 130 is now energized to move the elevator 128 upwardly to position tray 126 at the loading station and drawer 124 about 74 centimeters above the floor at the unloading station. Motor 141 is now energized to move door 136 downwardly to the top of drawer 124. Switch 149 is now energized indicating that the door is at the top of the drawer. The operator now removes the sets of copy sheets from drawer 124. After the sets of copy sheets have been removed from drawer 124, switch 151 is actuated signaling the controller that the sets of copy sheets have been removed. The controller than energizes motor 132 to move drawer 124 back to the loading station internal of the finishing station. This closes switch 145 and opens switch 147. The controller, in response to switch 147 being opened and switch 145 being closed, actuates motor 141 to move door 136 downwardly to the fully closed position actuating switch 153 and completing the cycle.

Elevator 128 includes two struts, one struts on each side thereof. The struts support drawer 124 horizontally and are mounted vertically slidable in the elevator frame. The ends of the struts are mounted on two drive screws connected by a drive belt and pulleys to motor 130. As motor 130 rotates in one direction, the elevator move from the discharge station to the loading station. When motor 130 reverses direction, the elevator moves from the loading station to the discharge station. Drawer 124 is mounted on slides on elevator 128. Motor 132 is mounted to the rear of the elevator. The drive train includes a belt a pulley mounted on motor 132 and a pulley mounted on elevator. The belt is clamped to the drawer. As the motor rotates, the belt translates the drawer from the discharge station to the intermediate station and from the unloading station to the loading station. Switch 147 is mounted under the drawer toward the front. The switch is actuated by a protruding ramp at the bottom rear of the drawer when the drawer is fully out at the intermediate station and the unloading station. The switch then signals the controller and the drive is stopped. Switch 145 is mounted under the drawer toward the rear. The switch is actuated by a ramp which is at the bottom front of the drawer. When the drawer is fully in, at the discharge station and loading station, switch 145 signals the controller and the drive is stopped. Sensor 151 is located under the front surface of the drawer. When copy sheets are laying on the drawer over the sensor, light from the sensor light emitting diode is reflected back to the sensor. At the completion of the drawer drive out cycle, the controller monitors the sensor state. When the operator removes the sets of copy sheets, the sensor no longer receives reflected light from the light emitting diode. The sensor state changes and the controller signals to drive the drawer from the intermediate station to the loading station.

Figure 4:
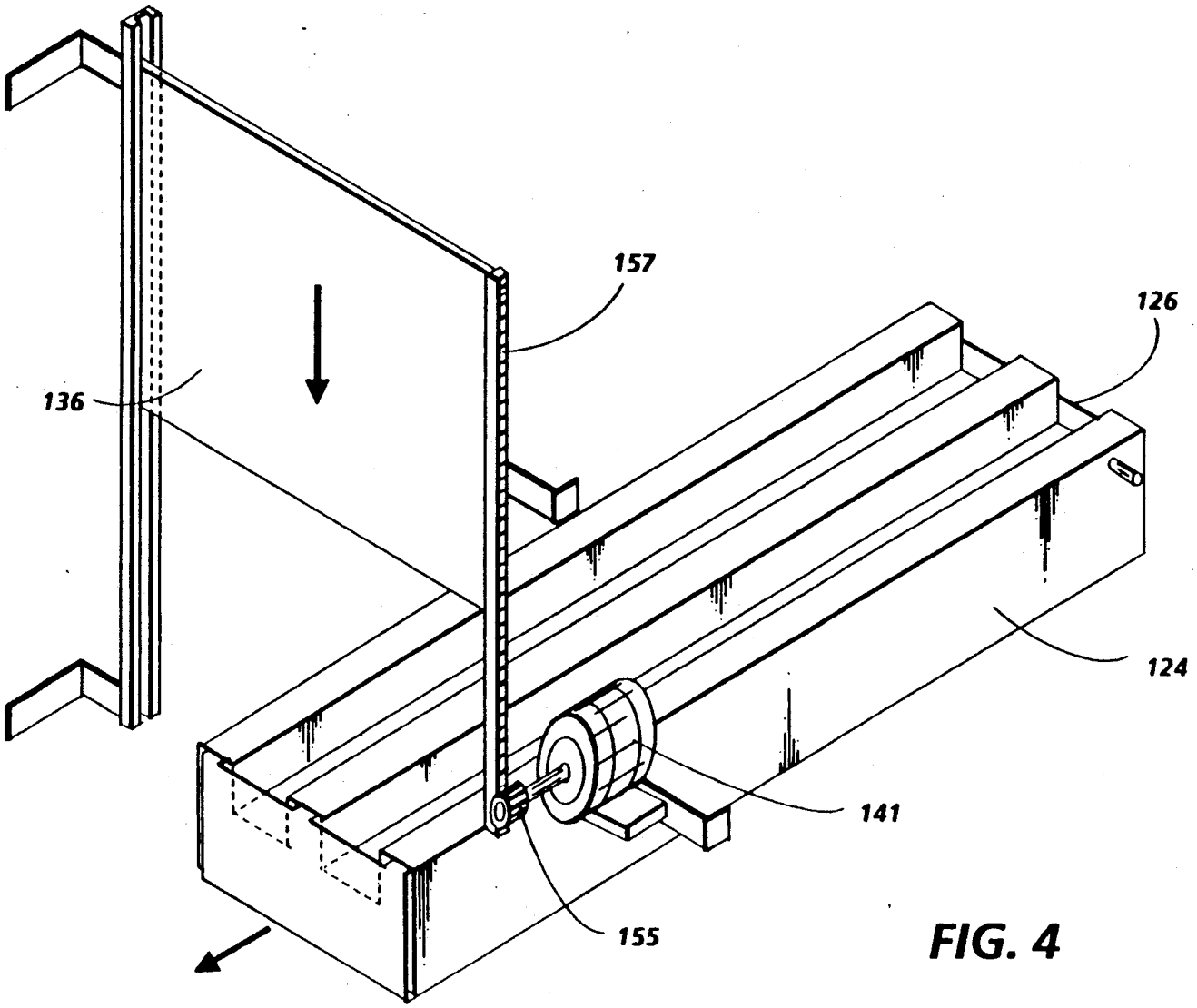
FIG. 4 is a perspective view depicting the door of the FIG. 2 finishing station housing.

FIG. 4 shows the operation of the door 136. Door 136 is mounted vertically slidably in the cover of the finishing station of the printing machine. Both the loading station and the discharge station are located internally of the finishing station of the printing machine. The intermediate station and the unloading station are positioned externally of the finishing station of the printing machine. The upper surface of tray 126 has descended below the upper surface of drawer 124. Motor 141 is energized to rotate gear 155. Gear 155 meshes with rack 157. Rack 157 is mounted on door 136. As motor 141 rotates gear 155, rack 157 translates upwardly or downwardly moving door 136 therewith. In this way, door 136 opens enabling the sets of copy sheets transferred from tray 126 to drawer 124 to move therewith from the discharge station to the intermediate station, and then to the unloading station where the operator removes the sets of copy sheets therefrom.

In recapitulation, the sheet stacking apparatus of the present invention includes a tray which receives sets of sheets at a loading station and moves the sets of sheets to a discharge station. At the discharge station, the sets of sheets are transferred to a drawer. The drawer moves the sets of sheets from a discharge station to an unloading station. As the sets of sheets are being unloaded from the drawer, additional sets of sheets are being loaded on the tray.

It is, therefore, evident that there has been provided, in accordance with the present invention, a sheet stacking apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for stacking sheets, including:

means for supporting sheets, said supporting means receiving sheets at a loading station;

means for advancing the sheets from a discharge station to an unloading station;

first means for moving said supporting means and said advancing means from the loading station to the discharge station;

second means for moving said supporting means relative to said advancing means, at the discharge station, to transfer the sheets from said supporting means to said advancing means;

an enclosure having an aperture therein with the discharge station being located interiorly of said enclosure and the unloading station being located exteriorly of said enclosure; and means for opening and closing the aperture in said enclosure, said opening and closing means opening the aperture in said enclosure in synchronism with said advancing means moving the sheets from the discharge station to the unloading station to enable the sheets to pass therethrough.

2. An apparatus according to claim 1, further including first means for detecting that the uppermost sheet of the sheets on said supporting means is located at a preselected position in the loading station, said first moving means, in response to said first detecting means detecting that the uppermost sheet of the sheets on said supporting means is not at the preselected position, moves said supporting means and said advancing means so that the uppermost sheet of the sheets on said supporting means is continuously maintained at the preselected position in the loading station as sheets are added to said supporting means.

3. An apparatus according to claim 2, further including second means for detecting that said first moving means moved said supporting means and said advancing means to the discharge station, said second moving means, in response to said second detecting means detecting that said supporting means and said advancing means are located at the discharge station, moves said supporting means relative to said advancing means to transfer the sheets from said supporting means to said advancing means.

4. An apparatus according to claim 3, wherein said opening and closing means opens the aperture in the enclosure in response to said second detecting means detecting that said first moving means has moved said supporting means and said advancing means to the discharge station.

5. An apparatus according to claim 4, further including third means for detecting that said opening and closing means has opened the aperture in said enclosure, said advancing means, in response to said third detecting means detecting that said opening and closing means has opened the aperture in said enclosure advances said supporting means from the discharge station to an intermediate station located exterior of the enclosure.

6. An apparatus according to claim 5, further including fourth means for detecting that said advancing means has advanced the sheets to the intermediate station, said first moving means moving said advancing means and said supporting means to position said advancing means at the unloading station and said supporting means at the loading station.

7. An apparatus according to claim 6, further including fifth means for detecting that the sheets has been removed from said advancing means at the unloading station, said advancing means, in response to said fifth detecting means detecting that the sheets has been removed from said advancing means at the unloading station, returning to the loading station.

8. An apparatus according to claim 1, wherein said supporting means includes a tray having a series of spaced-apart tray surfaces arranged to support sheets thereon.

9. An apparatus according to claim 8, wherein said advancing means includes a drawer having a series of spaced-apart drawer surfaces arranged to support sheets thereon, said drawer surfaces extending along respective spaces between said tray surfaces such that said tray surfaces pass through said drawer surfaces.

10. An apparatus according to claim 9, wherein said advancing means includes means for translating said drawer in a substantially horizontal direction from the discharge station to an intermediate station located exteriorly of the enclosure and from the unloading station to the discharge station.

11. An apparatus according to claim 10, wherein said opening and closing means includes:

a door mounted movably on said enclosure; and a drive system for moving said drawer in synchronism with the translation of said drawer to open the enclosure as said drawer translates from the discharge station to the intermediate station.

12. An apparatus according to claim 11, wherein said first moving means moves said tray and said drawer in a substantially vertical direction from the loading station to the discharge station.

13. An apparatus according to claim 12, wherein said second moving means moves said tray relative to said drawer so that said tray surfaces pass through said drawer surfaces at the discharge station to transfer the stack of sheets from said tray surfaces to said drawer surfaces.

14. An apparatus wherein a plurality of sets of sheets are advanced to said supporting means according to claim 1, wherein said second moving means off-sets adjacent sets of sheets from one another on said supporting means at the loading station.

15. An electrophotographic printing machine of the type in which successive copy sheets having indicia recorded thereon are advanced to a finishing station, wherein the improvement includes:

means for supporting sheets, said supporting means receiving sheets at a loading station;

means for advancing the sheets from a discharge station to an unloading station;

first means for moving said supporting means and said advancing means from the loading station to the discharge station;

second means for moving said supporting means relative to said advancing means, at the discharge station, to transfer the sheets from said supporting means to said advancing means;

an enclosure having an aperture therein with the discharge station being located interiorly of said enclosure and the unloading station being located exteriorly of said enclosure; and means for opening and closing the aperture in said enclosure, said opening and closing means opening the aperture in said enclosure in synchronism with said advancing means moving the sheets from the discharge station to the unloading station to enable the sheets to pass therethrough.

16. A printing machine according to claim 15, further including first means for detecting that the uppermost sheet of the sheets on said supporting means is located at a preselected position in the loading station, said first moving means, in response to said first detecting means detecting that the uppermost sheet of the sheets on said supporting means is not at the preselected position, moves said supporting means and said advancing means so that the uppermost sheet of the sheets on said supporting means is continuously maintained at the preselected position in the loading station as sheets are added to said supporting means.

17. A printing machine according to claim 16, further including second means for detecting that said first moving means moved said supporting means and said advancing means to the discharge station, said second moving means, in response to said second detecting means detecting that said supporting means and said advancing means are located at the discharge station, moves said supporting means relative to said advancing means to transfer the sheets from said supporting means to said advancing means.

18. A printing machine according to claim 17, wherein said opening and closing means opens the aperture in the enclosure in response to said second detecting means detecting that said first moving means has moved said supporting means and said advancing means to the discharge station.

19. A printing machine according to claim 18, further including third means for detecting that said opening and closing means has opened the aperture in said enclosure, said advancing means, in response to said third detecting means detecting that said opening and closing means has opened the aperture in said enclosure advances said supporting means from the discharge station to an intermediate station located exterior of the enclosure.

20. A printing machine according to claim 19, further including fourth means for detecting that said advancing means has advanced the sheets to the intermediate station, said first moving means moving said advancing means and said supporting means to position said advancing means at the unloading station and said supporting means at the loading station.

21. A printing machine according to claim 20, further including fifth means for detecting that the sheets has been removed from said advancing means at the unloading station, said advancing means, in response to said fifth detecting means detecting that the sheets has been removed from said advancing means at the unloading station, returning to the loading station.

22. A printing machine according to claim 15, wherein said supporting means includes a tray having a series of spaced-apart tray surfaces arranged to support copy sheets thereon.

23. A printing machine according to claim 22, wherein said advancing means includes a drawer having a series of spaced-apart drawer surfaces arranged to support copy sheets thereon, said drawer surfaces extending along respective spaces between said tray surfaces such that said tray surfaces pass through said drawer surfaces.

24. A printing machine according to claim 23, wherein said advancing means includes means for translating said drawer in a substantially horizontal direction from the discharge station to an intermediate station located exteriorly of the enclosure.

25. A printing machine according to claim 24, wherein said opening means includes:

a door mounted movably on said enclosure; and a drive system for moving said drawer in synchronism with the translation of said drawer to open the enclosure as said drawer translates from the discharge station to the intermediate station.

26. A printing machine according to claim 25, wherein said first moving means moves said tray and said drawer in a substantially vertical direction from the loading station to the discharge station.

27. A printing machine according to claim 26, wherein said second moving means said tray relative to said drawer so that said tray surfaces pass through said drawer surfaces at the discharge station to transfer the stack of sheets from said tray surfaces to said drawer surfaces.

28. A printing machine wherein a plurality of sets of copy sheets are advanced to said supporting means according to claim 15, wherein said second moving means off-sets adjacent sets of sheets from one another on said supporting means at the loading station.

* * * * *